US005582012A

United States Patent [19]

Tunkel et al.

[11] Patent Number: 5,582,012

[45] Date of Patent: Dec. 10, 1996

[54] METHOD OF NATURAL GAS PRESSURE REDUCTION ON THE CITY GATE STATIONS

[75] Inventors: Lev Tunkel, Edison, N.J.; Boris Krasovitski, Nesher, Israel; Robert L. Foster, Manasquan, N.J.

[73] Assignee: Universal Vortex, Inc., Robbinsville, N.J.

[21] Appl. No.: 441,088

[22] Filed: May 15, 1995

[51] Int. Cl.[6] ..... F25B 9/02

[52] U.S. Cl. ..... 62/5

[58] Field of Search ..... 62/5

[56] References Cited

U.S. PATENT DOCUMENTS

| | | | |
|---|---|---|---|
| 3,775,988 | 12/1973 | Fekete | 62/5 |
| 3,973,396 | 8/1976 | Kronogard | 62/5 |
| 4,584,838 | 4/1986 | AbuJudom, II | 62/5 |

OTHER PUBLICATIONS

A Similarity Relation for Energy Separation in a Vortex Tube, K. Stephenn et al. vol. 27, No. 6, pp. 911–920, 1984.

*Primary Examiner*—Ronald C. Capossela
*Attorney, Agent, or Firm*—McAulay Fisher Nissen Goldberg & Kiel, LLP.

[57] ABSTRACT

A method of natural gas pressure reduction at a City Gate station providing an elimination of the station's energy consumption for gas flow heating together with the creation of a cooling duty for further utilization which comprises connecting a vortex tube inlet with a gas flow line for applying the whole gas flow entering the City Gate, connecting a cold fraction gas flow outlet from the vortex tube with a heat exchanger for warming the cold fraction gas, and outletting the warmed cold fraction gas, connecting a vortex tube's hot fraction outlet with the warmed cold fraction outlet from the heat exchanger, to combine the hot fraction outlet with the warmed cold fraction outlet; and connecting the combined hot fraction and warmed cold fraction to the pipeline leaving the station, the method of the invention is also useful in connection with natural gas pressure reduction at a City Gate station equipped with a heater and a JT valve providing a reduction of energy consumption for gas flow heating, together with creation of a cooling duty for further utilization.

10 Claims, 2 Drawing Sheets

METHOD OF NATURAL GAS PRESSURE REDUCTION ON THE CITY GATE STATIONS

BACKGROUND OF THE INVENTION

Field of the Invention

The present invention relates to gas pressure drop installations and, in particular, to City Gate natural gas pressure reduction stations.

Description of the Prior Art

It is generally known and quite common in the industry that natural gas high pipeline pressure has to be reduced at City Gate stations in order to meet the low pressure gas distributing network requirements. Natural gas is a mixture of hydrocarbon used for fuel.

This operation which is performed in so called JT valves cause (due to the Joule-Thomson effect) a natural gas temperature drop. The greater the inlet/outlet gas pressure difference, the more of that drop value. As a result, the natural gas temperature after pressure reduction becomes much less than the City Gate station location's ground temperature. In most situations, the resulting temperatures are less than the critical temperature to freeze $H_2O$.

Bearing in mind that both inlet and outlet City Gate pipelines are typically underground, the freezing and ground distortion by heaving will occur in the soil around the downstream pipeline, which leads to the pipeline distraction and eventual failure. A potentially dangerous condition.

To prevent such undesirable developments natural gas at the City Gate stations is constantly heated prior to the pressure reducing JT valve. The typical existing layout comprises a heater and a JT valve connected in series, with the heater inlet connected with the gas pipeline entering the station and the JT valve outlet connected with the gas pipeline leaving the station. The quantity of energy required for the heating process depends on the pressure drop value, flow volume and the inlet gas temperature. This typically varies from station to station and can vary within certain parameters within a single station depending on system feed in relation to downstream product demand.

Nevertheless, the total energy consumption for heating at any given station is always substantial due to the steady flow and the typical volumes of the gas involved.

A vortex tube design as set forth in U.S. Pat. No. 5,327,728 to Tunkel is particularly useful in connection with this invention.

SUMMARY OF THE INVENTION

To this end, the present invention consists in the provision of a method of the natural gas pressure reduction at the City Gate station providing a substantial reduction of the station's energy consumption for heating the gas flow prior to pressure reduction, together with creation of the cooling duty for further utilization. The system harnessing this method comprises a vortex tube connected with the gas pipeline entering the station prior to the existing heater with a vortex tube's cold fraction pipeline connected with a heat exchanger, and a vortex tube's hot fraction pipeline connected with the cold fraction pipeline leaving the heat exchanger and the pipeline containing both combined flows connected with the gas pipeline leaving the station's JT valve.

Another object of the present invention consists in the provision of a method of the natural gas pressure reduction at the City Gate station providing a total elimination of the station's energy consumption for heating the gas flow together with creation of the cooling duty for further utilization. The system harnessing this method comprises a vortex tube connected with the gas pipeline entering the station with a vortex tube's cold fraction pipeline connected with a heat exchanger and a vortex tube's hot fraction pipeline connected with the cold fraction pipeline leaving the heat exchanger and the pipeline containing both combined flows connected with the gas pipeline leaving the station.

DETAILED DESCRIPTION OF THE INVENTION

Figure 1:
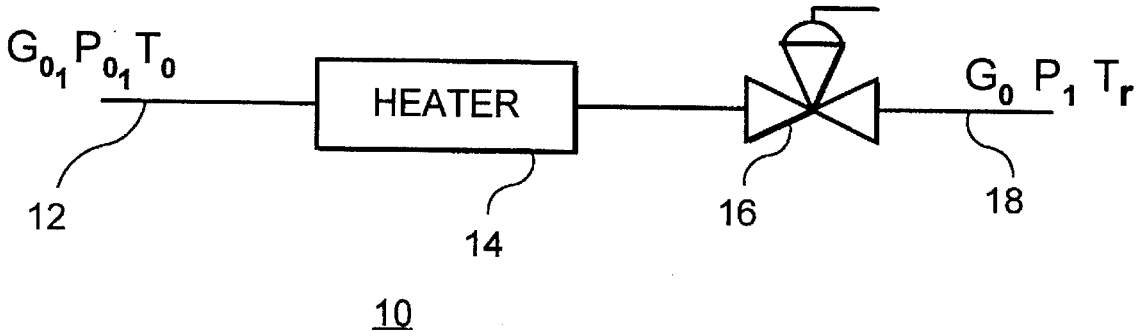
F I G. 1 PRIOR ART
FIG. 1 is a schematic flow diagram of an existing City Gate gas treatment system.

Referring now more particularly to FIG. 1 which schematically shows an existing conventional City Gate gas treatment system 10 and comprises an entry line 12, a heater 14 and a JT (Joule-Thomson) valve 16 and exit line 18.

A natural gas flow entering the station with the flow rate $G_o$, pressure $P_o$ and temperature $T_o$ is heated in a heat exchanger and then goes through a JT valve where the gas undergoes the pressure and the temperature drop. As a result the natural gas leaves a station with the required pressure $P_1$ and temperature $T_r$ value. The temperature $T_r$ is set above of the ground water freezing temperature.

Figure 2:
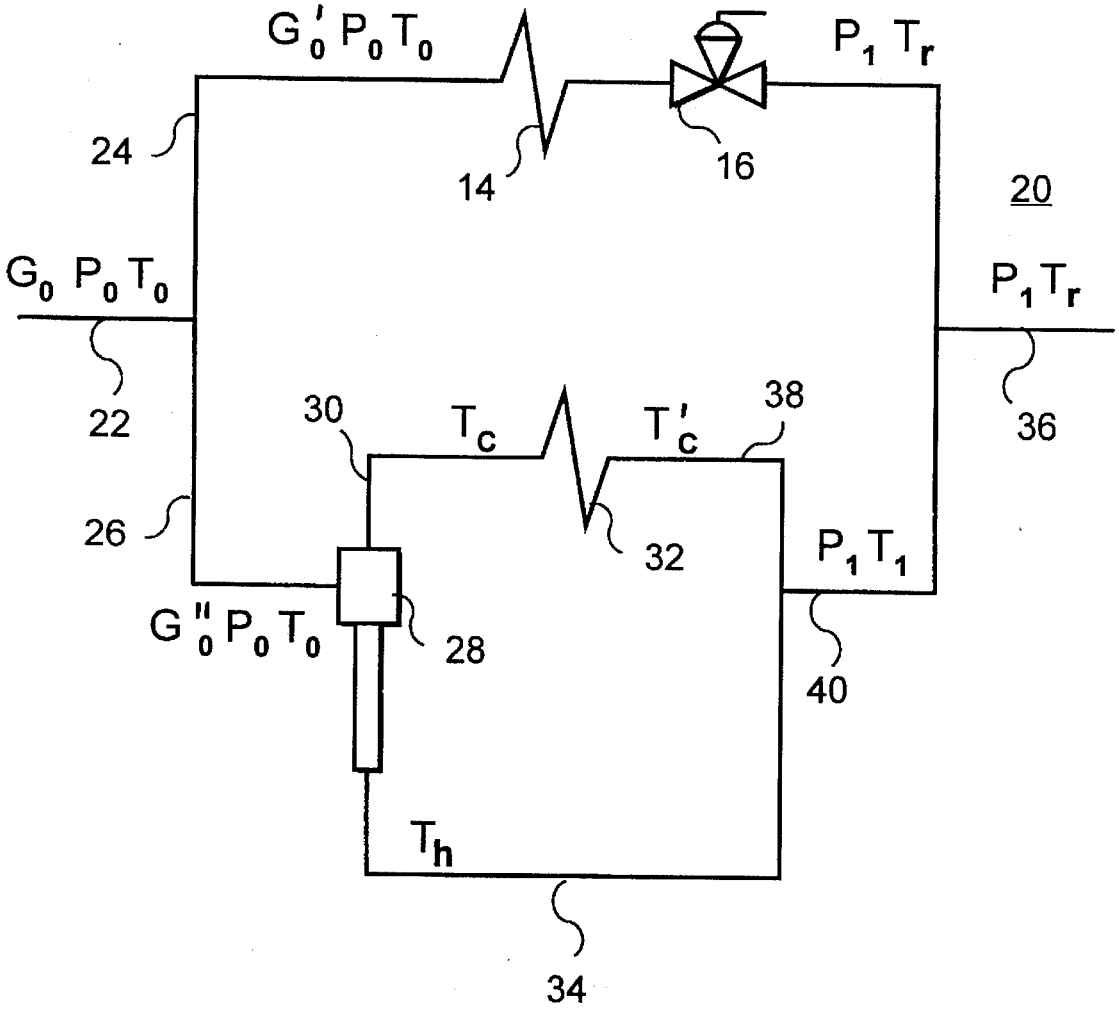
FIG. 2 is a schematic flow diagram of one embodiment of the present invention.

As is shown on the flow diagram of FIG. 2, which shows one embodiment of the invention, a station's gas treatment system 20 according to the invention includes an existing heater 14 and JT valve 16 and also a vortex tube 28 and a heat exchanger 32. A gas flow 22 enters the station 20 with a flow rate $G_o$, a pressure $P_o$ and a temperature $T_o$ and is divided into two parts to form two flow paths 24 and 26. One flow path 24 $G_o^1$ is directed through the existing system heater 14 and JT valve 16. The other flow $G_o^{11}$ is sent through path 26 ($G_o^1+G_o^{11}=G_o$) to the Vortex Tube 28, where under the inlet/outlet gas pressure ratio $P_o/P_1$ available, the gas undergoes an energy (temperature) separation and cold and hot fractions are created.

The vortex tube performance, in other words, the temperature differences, as well as the actual cold and hot fraction flow rates, are determined in order to provide an actual cold fraction temperature $T_c$ in output line 30 from Vortex Tube 28 lower than the temperature of the chosen medium to be cooled in the heat exchanger 32 and the hot fraction actual temperature $T_h$ in output through line 34 higher than the temperature $T_r$ required for the gas leaving the station 20 through line 36.

The cold gas or the cold fraction is then directed through line 30, then goes through heat exchanger 32 where it is warmed to some determined temperature $T_c^1$. After the heat exchanger 32, the warmed cold gas is directed into line 38 and then mixes with the flow of hot gas from line 34 and flows into line 40. These legs or lines 34 and 40 of the flow circuit are contained within insulated pipes and valves.

It is important to emphasize that under a properly selected combination of the vortex tube design and its mode of operation (at this point one may use the disclosure of the U.S. Pat. No. 5,327,728) matched with the heat exchanger duty, the re-combined flow in line 40 (cold stream and hot stream) would have a final temperature, $T_1$ sufficiently warm enough so that when mixed with the warmed gas flow after the JT valve, will produce a final flow which is with equal to or above the required minimum gas temperature, (usually 35° F.) $T_r$ sent downstream to the user base through the underground pipeline system.

It should be understood that when $T_1$ is equal to $T_r$ the station's energy consumption should be reduced proportionally to the vortex tube input gas flow rate ($G_o^{11}$), which no longer needs to be treated in the heater; also, when $T_1$ is above $T_r$ the heater's duty can be reduced additionally in order to meet the required value of $T_r$ for the final combined gas flow. In general, such a situation is typical in late spring and summer when the heat exchanger using the ambient air as a heating medium provides a relatively high temperature of the cold fraction flow.

It also should be understood that the cooling duty provided in the heat exchanger by the Vortex Tube's cold stream can be utilized and put to work in a wide variety of applications. In the cooling duty availability estimations one has to be aware that both the natural gas temperature drops due to the vortex phenomenon and Joule-Thomson phenomenon (which also takes place in the vortex tube) are arithmetically added, so that very low actual gas temperatures may be achieved.

In evaluating the vortex tube performance in this flow diagram, one needs to take into account the variability of the flow rate on the station which in general calls for variability of the vortex tube's capacity. The most effective and reliable way to comply with the variables is to have a set of the vortex tubes (two-three units of equal size) with a total capacity of close or equal to the average station flow rate.

This arrangement will provide a series (2 or 3) of vortex tubes to turn on and off separately as flow variabilities require. Such an approach provides an opportunity to keep the vortex tube/tubes permanently loaded with the station's basic flow rates. The JT valve is also permanently loaded with the balance ($G_o$-$G_o^{11}$) of the station flow. Such an installation can be expected to accommodate any reasonable hourly/daily load swings of the customer's gas demand.

It should be understood that the vortex tube's capacity depends on the actual inlet pressure value. In other words, the actual $G_o^{11}$ flow rate varies according to the seasonably/daily/hourly pressure changes.

The actual number of vortex tubes on the station and their individual capacity should be determined separately for each station—and the capacity will also depend on the station's annual pattern of operation. Based on the selected total vortex tube/tubes capacity—among the other appropriate input data, the proper size of the heat exchanger can be determined.

It should also be understood that with the appropriate combination of the operational conditions at the City Gate station's location, for example with a relatively mild winter together with a relatively constant gas flow rate, an existing City Gate station's layout can be replaced completely with the sole vortex tube's based system.

Figure 3:
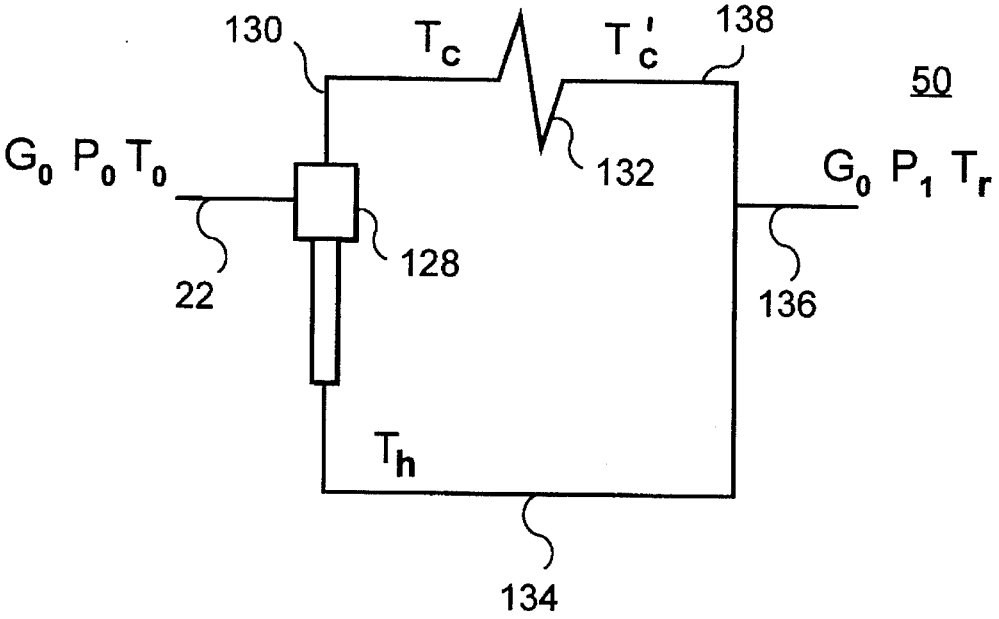
FIG. 3 is a schematic flow diagram of another embodiment of the present invention.

Referring now more particularly to FIG. 3 which shows another embodiment, a station's gas treatment system 40, the flow diagram is different from the flow diagram described in FIG. 1 or FIG. 2. In this embodiment, parts similar to the parts in FIGS. 1 and 2 have been raised by 100.

As is shown on the flow diagram of FIG. 3, such a station's gas treatment system 50 according to the invention, includes a vortex tube 128 and a heat exchanger 132. A gas flow 22 entering the station 50 with a flow rate $G_o$, a pressure $P_o$ and a temperature $T_o$ is directed solely to the vortex tube 128, where under the inlet/outlet gas pressure ratio $P_o/P_1$ available, the gas undergoes an energy (temperature) separation and cold and hot fractions are created. The cold gas or the cold fraction then goes through line 130, heat exchanger 132 and after being warmed to temperature $T_c^1$, goes through line 138 to be mixed in line 136 with hot gas from line 134. The combined hot and cold flow with the required pressure $P_1$ and temperature $T_r$ leaves the station directly through line 136.

While there has been shown and described what is considered to be the preferred embodiments of the invention, various changes and modifications may be made therein without departing from the scope of the invention.

What is claimed:

1. A method of natural gas pressure reduction at a City Gate station equipped with a healer and a JT valve providing a reduction of energy consumption for gas flow heating, together with creation of a cooling duty for further utilization comprising:

connecting a vortex tube inlet with a gas flow line prior to the gas flow's connection with a heater for applying a portion of the gas flow entering the City Gate;

connecting a cold fraction gas flow outlet from the vortex tube with a heat exchanger for warming the cold fraction gas, and outletting the warmed cold fraction gas;

connecting a vortex tube's hot fraction outlet with the warmed cold fraction gas outlet from the heat exchanger, to combine the hot fraction outlet with the warmed cold fraction outlet; and connecting the combined hot fraction and warmed cold fraction to the pipeline leaving the station's JT valve.

2. The method of claim 1, including maintaining the temperature of the combined gas after leaving the heat exchanger equal to the required minimum gas temperature after the JT valve.

3. The method of claim 2, including the step of proportionally reducing the station's energy consumption for gas flow heating relative to the vortex tube input gas flow rate.

4. The method of claim 1, including the step of proportionally reducing the station's energy consumption for gas flow heating relative to the vortex tube input gas flow rate.

5. The method of claim 1, including the step of maintaining the temperature of the combined gas after leaving the heat exchanger above the required minimum gas temperature after the JT valve.

6. The method according to claim 5, including reducing the heating imparted to the incoming gas line by the station's heater in order to keep the final combined gas flow temperature equal to a given required value.

7. The method according to claim 1, including reducing the heating imparted to the incoming gas line by the station's heater in order to keep the final combined gas flow temperature equal to a given required value.

8. A method of natural gas pressure reduction at a City Gate station providing an elimination of the station's energy consumption for gas flow heating together with creation of a duty for further utilization together with creation of a cooling duty for further utilization comprising:

connecting a vortex tube inlet with a gas flow line for applying the whole gas flow entering the City Gate;

connecting a cold fraction gas flow outlet from the vortex tube with a heat exchanger for warming the cold fraction gas, and outletting the warmed cold fraction gas;

connecting a vortex tube's hot fraction outlet with the warmed cold fraction gas outlet from the heat exchanger, to combine the hot fraction outlet with the warmed cold fraction outlet; and connecting the combined hot fraction and warmed cold fraction the pipeline leaving the station.

9. The method of claim 8, wherein the gas flow inlet is connected solely with the vortex tube's inlet.

10. The method of claim 8, wherein only the flows from the outlets of the vortex tube are connected to the pipeline leaving the station.

* * * * *